US009267762B2

(12) United States Patent
Northrup et al.

(10) Patent No.: US 9,267,762 B2
(45) Date of Patent: Feb. 23, 2016

(54) SYSTEM AND METHOD FOR MARKSMANSHIP TRAINING

(71) Applicant: Shooting Simulator, LLC, Yantis, TX (US)

(72) Inventors: James L. Northrup, Dallas, TX (US); Robert P. Northrup, Dallas, TX (US); Peter F. Blakeley, Yantis, TX (US)

(73) Assignee: Shooting Simulator, LLC, Yantis, TX (US)

( * ) Notice: Subject to any disclaimer, the term of this patent is extended or adjusted under 35 U.S.C. 154(b) by 141 days.

(21) Appl. No.: 13/890,997

(22) Filed: May 9, 2013

(65) Prior Publication Data

US 2014/0335478 A1 Nov. 13, 2014

(51) Int. Cl.
*F41G 3/26* (2006.01)
*F41A 33/02* (2006.01)

(52) U.S. Cl.
CPC ..... *F41G 3/2633* (2013.01); *F41A 33/02* (2013.01); *F41G 3/2655* (2013.01)

(58) Field of Classification Search
CPC ..... F41A 33/00; F41A 33/02; F41A 33/04; F41A 33/06; F41J 5/10; F41J 5/14; F41J 5/18
See application file for complete search history.

(56) References Cited

U.S. PATENT DOCUMENTS

| | | | | |
|---|---|---|---|---|
| 3,748,751 | A | 7/1973 | Breglia et al. | |
| 3,811,204 | A | 5/1974 | Marshall et al. | |
| 3,904,204 | A | 9/1975 | Yokoi | |
| 3,945,133 | A | 3/1976 | Mohon et al. | |
| 4,223,454 | A | 9/1980 | Mohon et al. | |
| 4,824,374 | A | 4/1989 | Hendry et al. | |
| 5,194,006 | A | 3/1993 | Zaenglien, Jr. | |
| 5,991,043 | A | 11/1999 | Andersson et al. | |
| 6,780,014 | B1 * | 8/2004 | Hull et al. | 434/22 |
| 6,942,486 | B2 | 9/2005 | Lvovskiy | |
| 6,997,716 | B2 | 2/2006 | Skala et al. | |
| 7,329,127 | B2 | 2/2008 | Kendir et al. | |
| 7,810,273 | B2 | 10/2010 | Koch et al. | |
| 2007/0254266 | A1 | 11/2007 | Galanis et al. | |
| 2010/0201620 | A1 | 8/2010 | Sargent | |
| 2011/0207089 | A1 | 8/2011 | Lagettie et al. | |
| 2012/0183931 | A1 | 7/2012 | Galanis et al. | |
| 2013/0040268 | A1 | 2/2013 | Van der Walt et al. | |

FOREIGN PATENT DOCUMENTS

| | | |
|---|---|---|
| EP | 1218687 | 7/2003 |
| EP | 0944809 | 10/2003 |
| TW | 201241396 | 10/2012 |

* cited by examiner

*Primary Examiner* — Timothy A Musselman
(74) *Attorney, Agent, or Firm* — Schultz & Associates, P.C.

(57) ABSTRACT

A system and method for marksmanship training comprises a screen, a computer having a processor and a memory connected to the processor and adjacent the screen, a set of modified video images stored in the memory, a set of projectors for projecting the set of modified video images onto the screen, connected to the computer and adjacent the screen, the set of modified video images including a moving clay target image and a phantom clay target image adjacent the moving clay target image at a lead distance from the moving clay target image, a camera connected to the computer and adjacent the screen, a weapon adjacent the screen, and a laser operatively mounted in the weapon. The phantom clay target image has a contrast level range from a fully opaque image to a fully transparent image.

34 Claims, 16 Drawing Sheets

SYSTEM AND METHOD FOR MARKSMANSHIP TRAINING

FIELD OF THE INVENTION

The present invention relates to devices for teaching marksmen how to properly lead a moving target with a weapon. More particularly, the invention relates to optical projection systems to monitor and simulate trap, skeet, and sporting clay shooting.

BACKGROUND OF THE INVENTION

Marksmen typically train and hone their shooting skills by engaging in skeet, trap or sporting clay shooting at a shooting range. The objective for a marksman is to successfully hit a moving target by tracking at various distances and angles and anticipating the delay time between the shot and the impact. In order to hit the moving target, the marksman must aim the weapon ahead of and above the moving target by a distance sufficient to allow a projectile fired from the weapon sufficient time to reach the moving target. The process of aiming the weapon ahead of the moving target is known in the art as "leading the target". "Lead" is defined as the distance between the moving target and the aiming point. The correct lead distance is critical to successfully hit the moving target. Further, the correct lead distance is increasingly important as the distance of the marksman to the moving target increases, the speed of the moving target increases, and the direction of movement becomes more oblique.

FIG. 1 depicts the general dimensions of a skeet shooting range. Skeet shooting range 100 has high house 101 and low house 102 separated by distance 111. Distance 111 is about 120 feet. Station 103 is adjacent high house 101. Station 109 is adjacent low house 102. Station 110 is equidistant from high house 101 and low house 102 at distance 112. Distance 112 is about 60 feet. Station 106 is equidistant from high house 101 and low house 102 and generally perpendicular to distance 111 at distance 113. Distance 113 is 45 feet. Station 106 is distance 114 from station 103. Distance 114 is about 75 feet. Stations 104 and 105 are positioned along arc 121 between stations 103 and 106 at equal arc lengths. Each of arc lengths 122, 123, and 124 is about 27 feet. Stations 107 and 108 are positioned along arc 121 between stations 106 and 109 at equal arc lengths. Each of arc lengths 125, 126, and 127 is 26 feet, 8⅜ inches.

Target flight path 116 extends from high house 101 to marker 117. Marker 117 is positioned about 130 feet from high house 101 along target flight path 115. Target flight path 115 extends from low house 102 to marker 118. Marker 118 is about 130 feet from low house 102 along target flight path 116. Target flight paths 115 and 116 intersect at target crossing point 119. Target crossing point 119 is positioned distance 120 from station 110 and is 15 feet above the ground. Distance 120 is 18 feet. Clay targets are launched from high house 101 and low house 102 along target flight paths 115 and 116, respectively. Marksman 128 positioned at any of stations 103, 104, 105, 106, 107, 108, 109, and 110 attempts to shoot and break the launched clay targets.

FIG. 2 depicts the general dimensions of a trap shooting range. Trap shooting range 200 comprises firing lanes 201 and trap house 202. Stations 203, 204, 205, 206, and 207 are positioned along radius 214 from center 218 of trap house 202. Radius 214 is distance 216 from center 218. Distance 216 is 48 feet. Each of stations 203, 204, 205, 206, and 207 is positioned at radius 214 at equal arc lengths. Arc length 213 is 9 feet. Stations 208, 209, 210, 211, and 212 are positioned along radius 215 from center 218. Radius 215 is distance 217 from center 218. Distance 217 is 81 feet. Each of stations 208, 209, 210, 211, and 212 is positioned at radius 215 at equal arc lengths. Arc length 227 is 12 feet. Field 226 has length 221 from center 218 along center line 220 of trap house 202 to point 219. Length 221 is 150 feet. Boundary line 222 extends 150 feet from center 218 at angle 224 from center line 220. Boundary line 223 extends 150 feet from center 218 at angle 225 from center line 220. Angles 224 and 225 are each 22° from center line 220. Trap house 202 launches clay targets at various trajectories within field 226. Marksman 228 positioned at any of stations 203, 204, 205, 206, 207, 208, 209, 210, 211, and 212 attempts to shoot and break the launched clay targets.

FIGS. 3A, 3B, 3C, and 3D depict examples of target paths and associated projectile paths illustrating the wide range of lead distances and distances required of the marksman. The term "projectile," as used in this application, means any projectile fired from a weapon but more typically a shotgun round comprised of pellets of various sizes. For example, FIG. 3A shows a left to right trajectory 303 of target 301 and left to right intercept trajectory 304 for projectile 302. In this example, the intercept path is oblique, requiring the lead to be a greater distance along the positive X axis. FIG. 3B shows a left to right trajectory 307 of target 305 and intercept trajectory 308 for projectile 306. In this example, the intercept path is acute, requiring the lead to be a lesser distance in the positive X direction. FIG. 3C shows a right to left trajectory 311 of target 309 and intercepting trajectory 312 for projectile 310. In this example, the intercept path is oblique and requires a greater lead in the negative X direction. FIG. 3D shows a proximal to distal and right to left trajectory 315 of target 313 and intercept trajectory 316 for projectile 314. In this example, the intercept path is acute and requires a lesser lead in the negative X direction.

FIGS. 4A and 4B depict a range of paths of a clay target and an associated intercept projectile. The most typical projectile used in skeet and trap shooting is a shotgun round, such as a 12 gauge round or a 20 gauge round. When fired, the pellets of the round spread out into a "shot string" having a generally circular cross-section. The cross-section increases as the flight time of the pellets increases. Referring to FIG. 4A, clay target 401 moves along path 402. Shot string 403 intercepts target 401. Path 402 is an ideal path, in that no variables are considered that may alter path 402 of clay target 401 once clay target 401 is launched.

Referring to FIG. 4B, path range 404 depicts a range of potential flight paths for a clay target after being released on a shooting range. The flight path of the clay target is affected by several variables. Variables include mass, wind, drag, lift force, altitude, humidity, and temperature, resulting in a range of probable flight paths, path range 404. Path range 404 has upper limit 405 and lower limit 406. Path range 404 from launch angle θ is extrapolated using:

$$x=x_o+v_{xo}t+\tfrac{1}{2}a_xt^2+C_x \quad (1)$$

$$y=y_o+v_{yo}t+\tfrac{1}{2}a_yt^2+C_y \quad (2)$$

where x is the clay position along the x-axis, $x_o$ is the initial position of the clay target along the x-axis, $v_{xo}$ is the initial velocity along the x-axis, $a_x$ is the acceleration along the x-axis, t is time, and $C_x$ is the drag and lift variable along the x-axis, y is the clay position along the y-axis, $y_o$ is the initial position of the clay target along the y-axis, $v_{yo}$ is the initial velocity along the y-axis, $a_y$ is the acceleration along the y-axis, t is time, and $C_y$ is the drag and lift variable along the x-axis. Upper limit 405 is a maximum distance along the x-axis with $C_x$ at a maximum and a maximum along the y-axis with $C_y$ at a maximum. Lower limit 406 is a minimum distance along the x-axis with $C_x$ at a minimum and a minimum along the y-axis with $C_y$ at a minimum. Drag and lift are given by:

$$F_{drag}=\tfrac{1}{2}\rho v^2 C_D A \quad (3)$$

where $F_{drag}$ is the drag force, ρ is the density of the air, v is $v_o$, A is the cross-sectional area, and $C_D$ is the drag coefficient;

$$F_{lift}=\tfrac{1}{2}\rho v^2 C_L A \quad (4)$$

where $F_{lift}$ is the lift force, ρ is the density of the air, v is $v_o$, A is the planform area, and $C_L$ is the lift coefficient Referring to FIG. 5, an example of lead from the perspective of the marksman is described. Marksman 501 aims weapon 502 at clay target 503 moving along path 504 left to right. In order to hit target 503, marksman 501 must anticipate the time delay for a projectile fired from weapon 502 to intercept clay target 503 by aiming weapon 502 ahead of clay target 503 at aim point 505. Aim point 505 is lead distance 506 ahead of clay target 503 along path 504. Marksman 501 must anticipate and adjust aim point 505 according to a best guess at the anticipated path of the target.

Clay target 503 has initial trajectory angles γ and β, positional coordinates $x_1$, $y_1$ and a velocity $v_1$ Aim point 505 has coordinates $x_2$, $y_2$. Lead distance 506 has x-component 507 and y-component 508. X-component 507 and y-component 508 are calculated by:

$$\Delta x=x_2-x_1 \quad (5)$$

$$\Delta y=y_2-y_1 \quad (6)$$

where Δx is x component 507 and Δy is y component 508. As γ increases, Δy must increase. As γ increases, Δx must increase. As β increases, Δy must increase.

The prior art has attempted to address the problems of teaching proper lead distance with limited success. For example, U.S. Pat. No. 3,748,751 to Breglia et al. discloses a laser, automatic fire weapon simulator. The simulator includes a display screen, a projector for projecting a motion picture on the display screen. A housing attaches to the barrel of the weapon. A camera with a narrow band-pass filter positioned to view the display screen detects and records the laser light and the target shown on the display screen. However, the simulator requires the marksman to aim at an invisible object, thereby making the learning process of leading a target difficult and time-consuming.

U.S. Pat. No. 3,940,204 to Yokoi discloses a clay shooting simulation system. The system includes a screen, a first projector providing a visible mark on the screen, a second projector providing an infrared mark on the screen, a mirror adapted to reflect the visible mark and the infrared mark to the screen, and a mechanical apparatus for moving the mirror in three dimensions to move the two marks on the screen such that the infrared mark leads the visible mark to simulate a lead-sighting point in actual clay shooting. A light receiver receives the reflected infrared light. However, the system in Yokoi requires a complex mechanical device to project and move the target on the screen, which leads to frequent failure and increased maintenance.

U.S. Pat. No. 3,945,133 to Mohon et al. discloses a weapons training simulator utilizing polarized light. The simulator includes a screen and a projector projecting a two-layer film. The two-layer film is formed of a normal film and a polarized film. The normal film shows a background scene with a target with non-polarized light. The polarized film shows a leading target with polarized light. The polarized film is layered on top of the normal non-polarized film. A polarized light sensor is mounted on the barrel of a gun. However, the weapons training simulator requires two cameras and two types of film to produce the two-layered film making the simulator expensive and time-consuming to build and operate.

U.S. Pat. No. 5,194,006 to Zaenglein, Jr. discloses a shooting simulator. The simulator includes a screen, a projector for displaying a moving target image on the screen, and a weapon connected to the projector. When a marksman pulls the trigger a beam of infrared light is emitted from the weapon. A delay is introduced between the time the trigger is pulled and the beam is emitted. An infrared light sensor detects the beam of infrared light. However, the training device in Zaenglein, Jr. requires the marksman to aim at an invisible object, thereby making the learning process of leading a target difficult and time-consuming.

U.S. Patent Application Publication No. 2010/0201620 to Sargent discloses a firearm training system for moving targets. The system includes a firearm, two cameras mounted on the firearm, a processor, and a display. The two cameras capture a set of stereo images of the moving target along the moving target's path when the trigger is pulled. However, the system requires the marksman to aim at an invisible object, thereby making the learning process of leading a target difficult and time-consuming. Further, the system requires two cameras mounted on the firearm making the firearm heavy and difficult to manipulate leading to inaccurate aiming and firing by the marksman when firing live ammunition without the mounted cameras.

The prior art fails to disclose or suggest a system and method for simulating a lead for a moving target using recorded video images of clay targets projected at the same scale as viewed in the field and a phantom target positioned ahead of the clay targets having a variable contrast. Therefore, there is a need in the art for a shooting simulator that recreates moving targets at the same visual scale as seen in the field with a phantom target to teach proper lead of a moving target.

SUMMARY

In a preferred embodiment, a system and methods for marksmanship training are disclosed. In one embodiment, the system includes a recording system for capturing and recording a set of video images at a shooting range and a simulation system for displaying a set of modified video images.

In one embodiment, the recording system includes a set of cameras connected to a recorder. The set of cameras are positioned at a shooting range to capture and record a set of video images of a set of shot sequences. A "shot sequence," as used in this application, is a recorded launch of a clay target that lands. The set of video images is modified by overlaying a phantom clay target at a lead distance and a drop distance from the recorded clay target.

In another embodiment, a set of background videos is captured and recorded by the recording system. In this embodiment, the set of background videos is the set of shot sequences without the launch of the clay target. The set of background videos is recorded for the same amount of time as the set of shot sequences. In a preferred embodiment, each shot sequence has a corresponding background video. In this embodiment, the set of video images is further modified by overlaying a selectable hotspot onto the phantom clay target.

In one embodiment, the set of modified video images are loaded into the simulation system and projected onto a screen with a set of projectors at the same magnification level as perceived by a marksman at the shooting range. A weapon is provided which includes a mounted laser. The marksman aims the weapon at the phantom clay target on the screen. When the marksman pulls the trigger, a laser beam is emitted from the weapon. If the laser beam overlaps the image of the phantom target, then the shot attempt is a hit. A camera simultaneously records the shot attempts of the marksman for later analysis.

In another embodiment, the weapon includes a mounted infrared laser and the phantom clay target includes the selectable hotspot. When the marksman pulls the trigger, an infrared beam is emitted from the weapon and an infrared camera which is included in the simulation system detects the infrared beam. If the infrared beam overlaps the hotspot, then the shot attempt is a hit.

In one embodiment, a method for producing, running, and analyzing a simulation is disclosed. In this embodiment, the method includes the steps of recording a set of shot sequences, modifying the set of shot sequences by adding a phantom clay target to the set of shot sequences along an extrapolated path, at a variable contrast level, at a lead distance and at a drop distance, to create a set of modified shot sequences. The method further includes the steps of projecting the set of modified shot sequences onto a screen in a predetermined order related to the variable contrast level to train a marksman.

In another embodiment, a method for training a marksman is disclosed. In this embodiment, the method includes the steps of recording the set of shot sequences and the set of background videos, modifying the set of shot sequences by adding a phantom clay target and a hotspot to the phantom clay target, synchronously running the set of modified shot sequences and the set of background videos, projecting the set of modified shot sequences as a video source onto a screen, determining a selection of the hotpot, switching the video source to the set of background videos if the hotspot is selected, and projecting the set of background videos as the video source onto the screen.

BRIEF DESCRIPTION OF THE DRAWINGS

The disclosed embodiments will be described with reference to the accompanying drawings.

DETAILED DESCRIPTION

Figure 1:
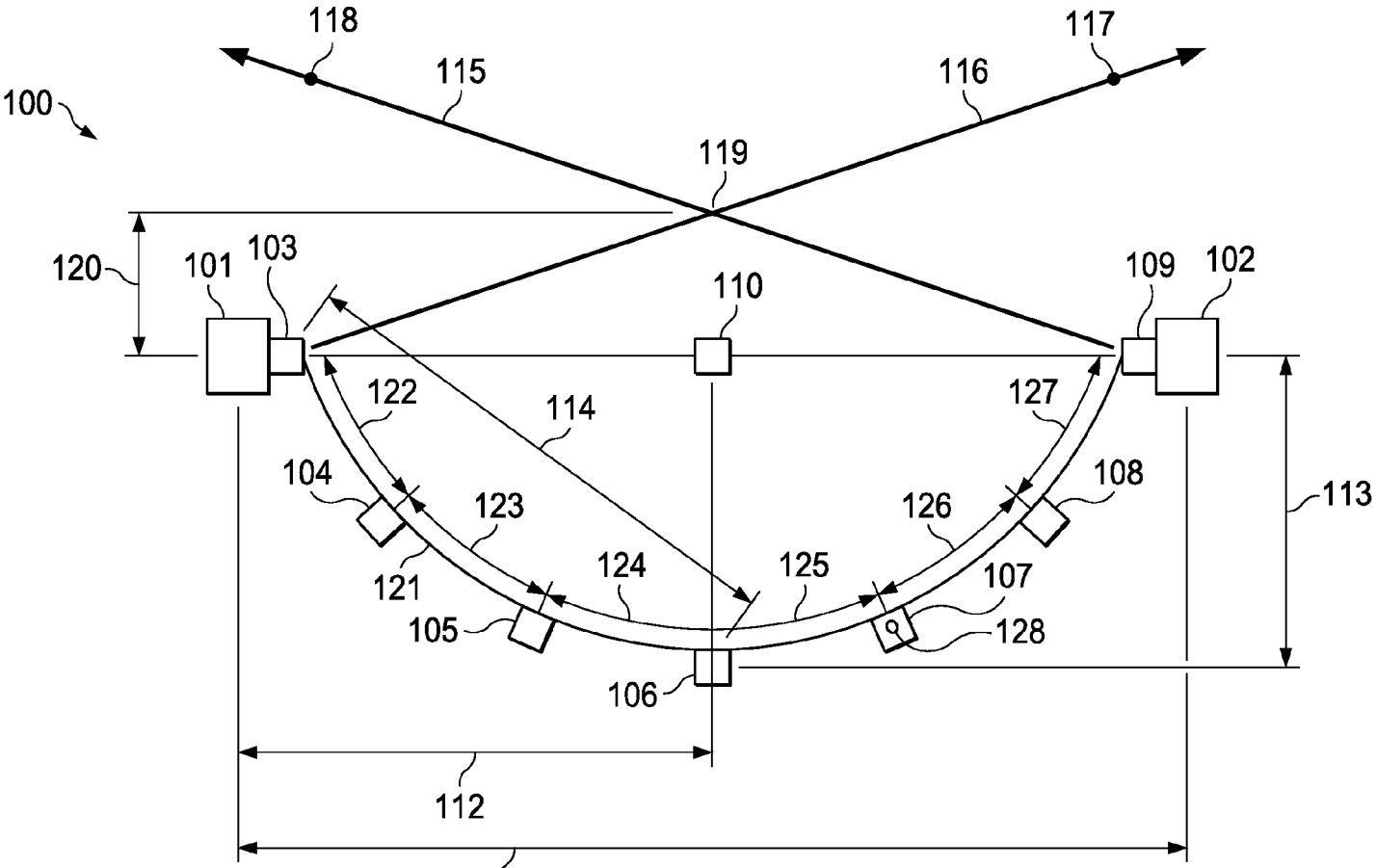
FIG. 1 is a plan view of a skeet shooting range.
Figure 2:
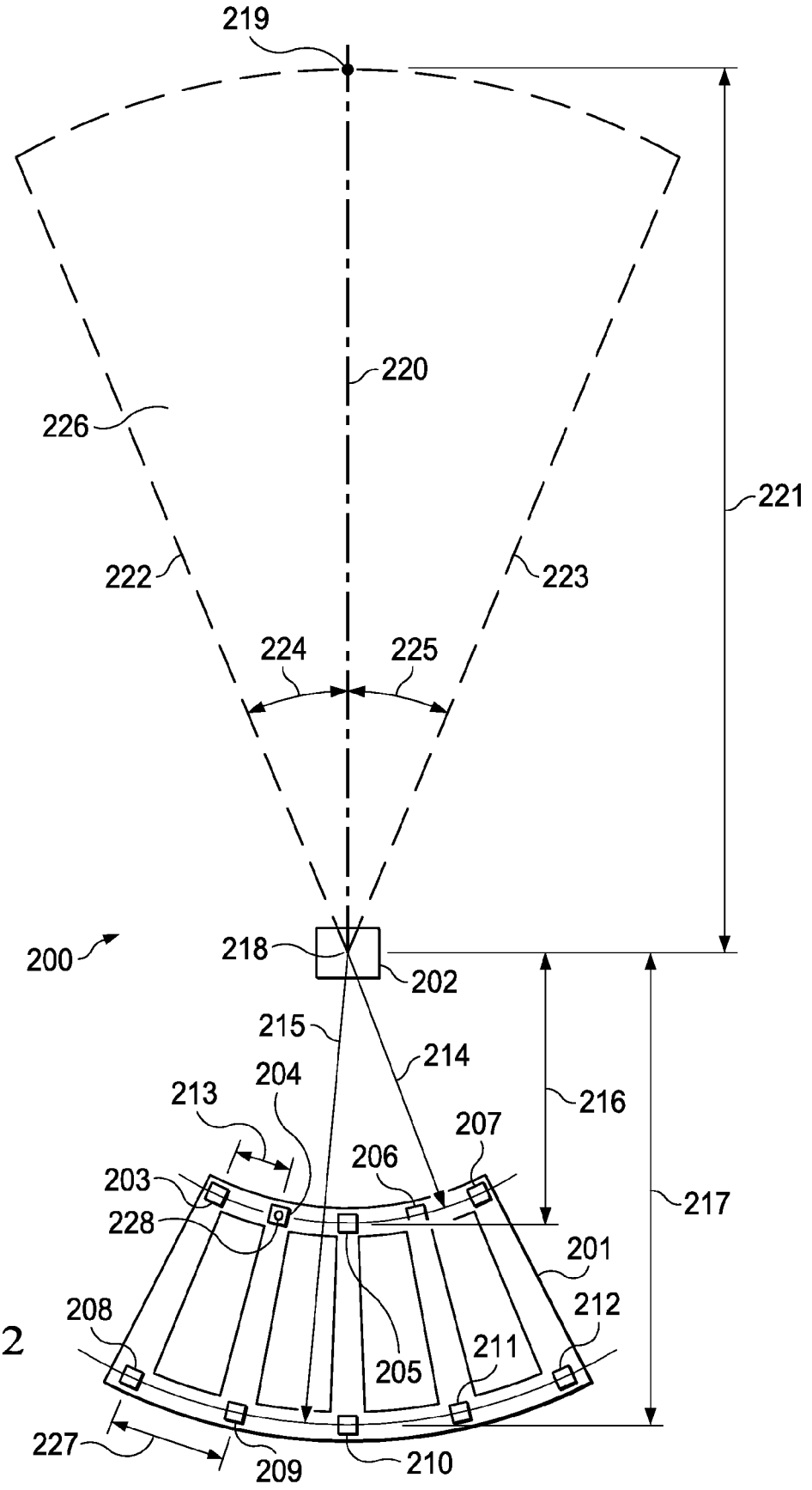
FIG. 2 is a plan view of a trap shooting range.
Figure 3A:
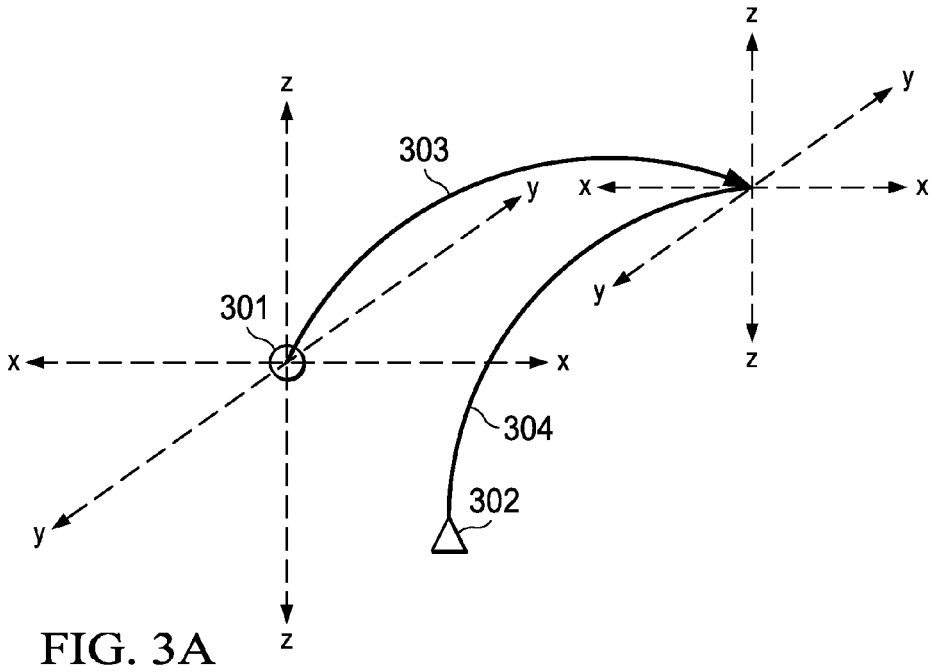
FIG. 3A is a clay target path and an associated projectile path.
Figure 3B:
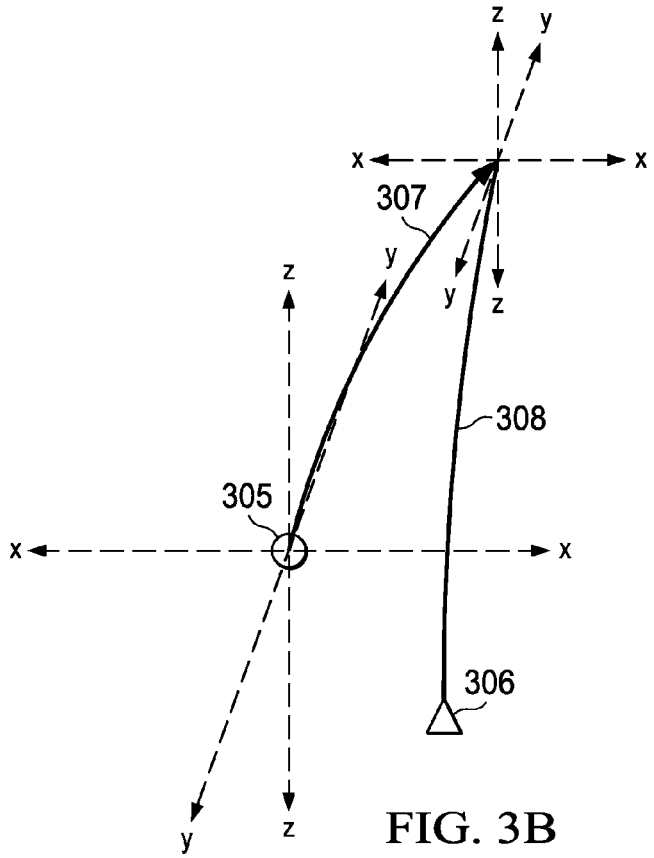
FIG. 3B is a clay target path and an associated projectile path.
Figure 3C:
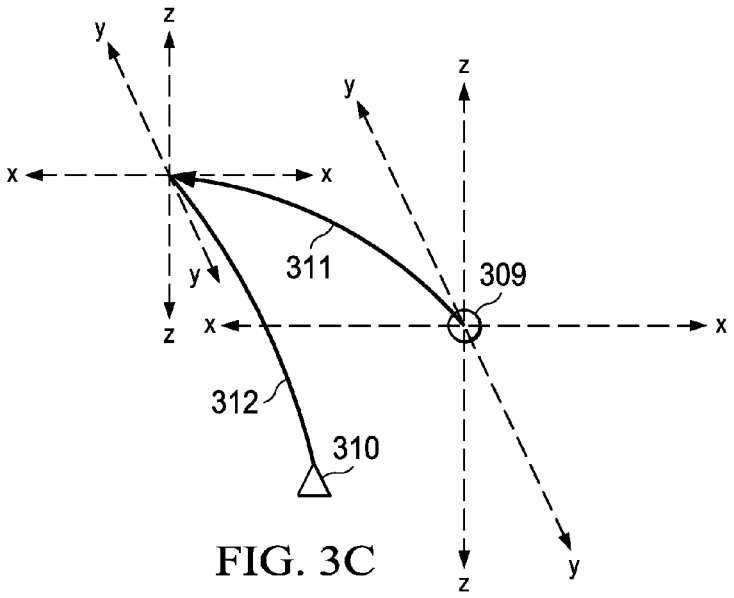
FIG. 3C is a clay target path and an associated projectile path.
Figure 3D:
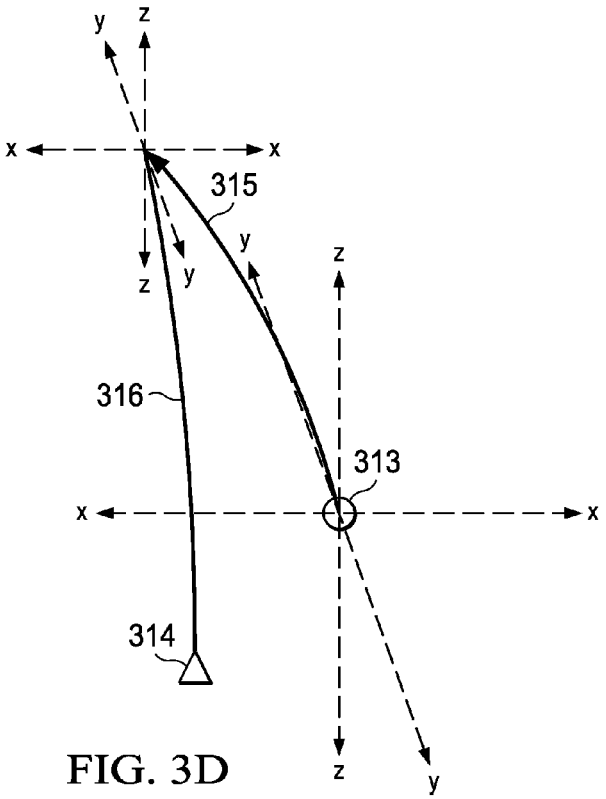
FIG. 3D is a clay target path and an associated projectile path.
Figure 4A:
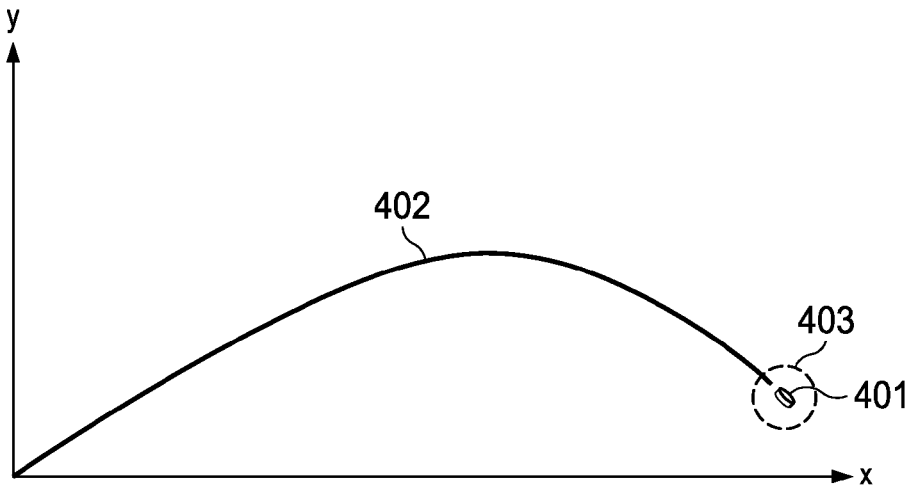
FIG. 4A is an ideal path of a moving clay target.
Figure 4B:
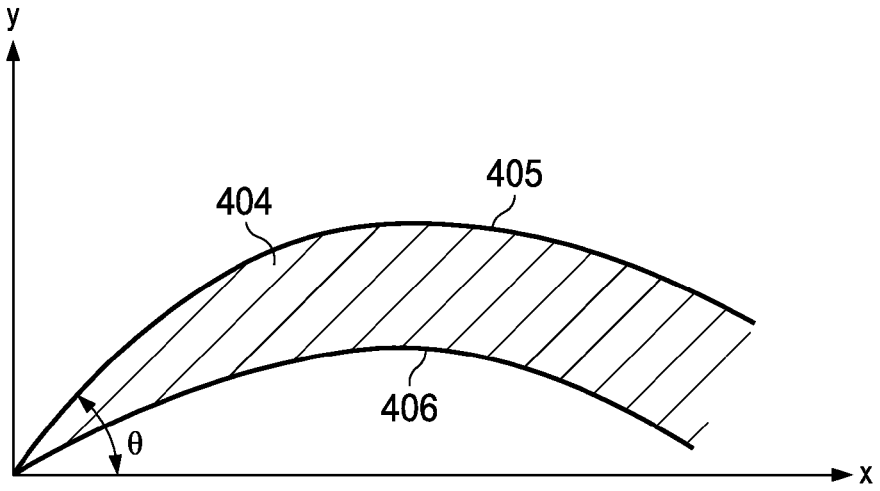
FIG. 4B is a range of probable flight paths of a clay target.
Figure 5:
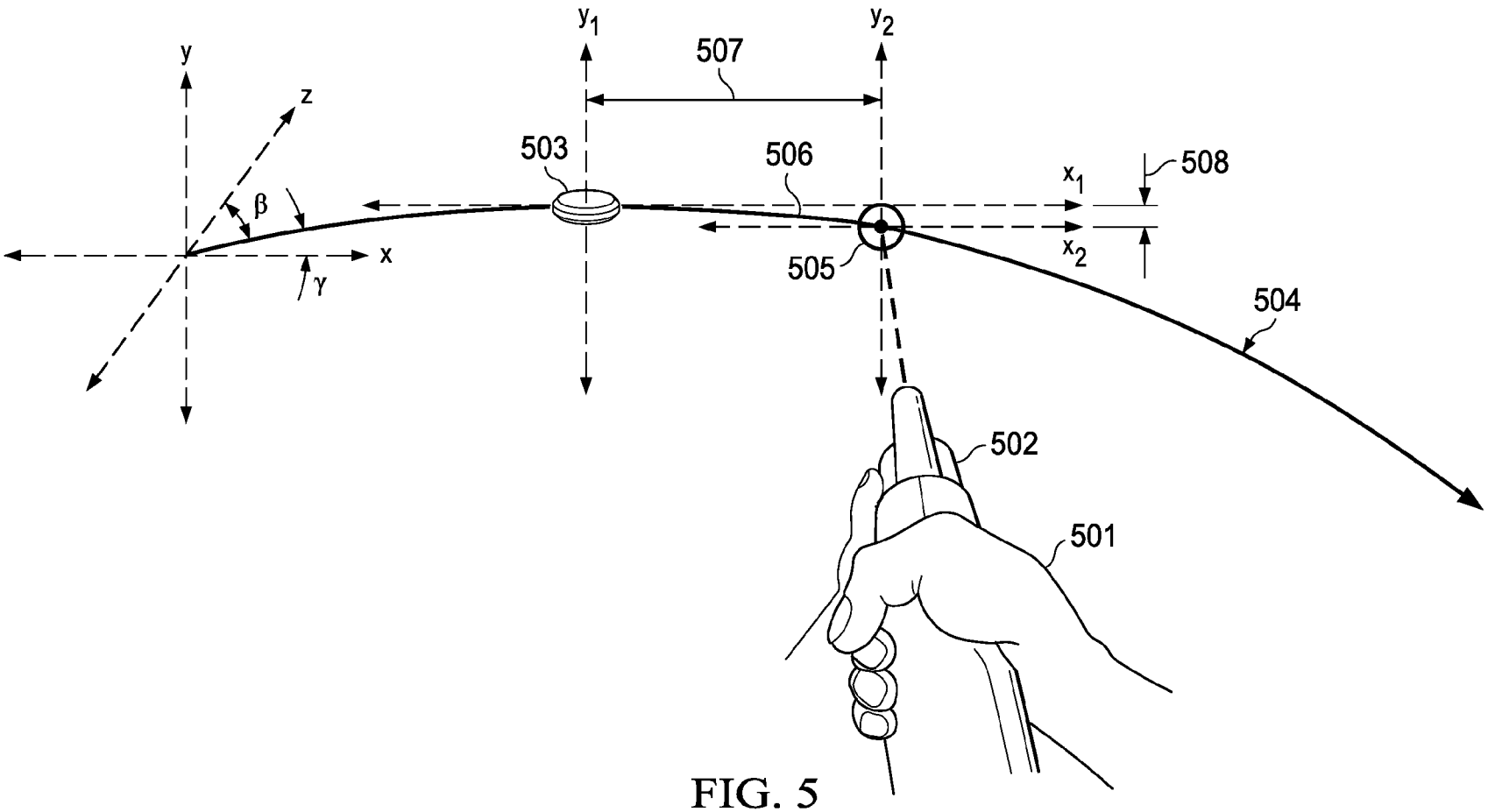
FIG. 5 is a perspective view of a marksman aiming at a moving clay target.

It will be appreciated by those skilled in the art that aspects of the present disclosure may be illustrated and described herein in any of a number of patentable classes or context including any new and useful process, machine, manufacture, or composition of matter, or any new and useful improvement thereof. Therefore, aspects of the present disclosure may be implemented entirely in hardware, entirely in software (including firmware, resident software, micro-code, etc.) or combining software and hardware implementation that may all generally be referred to herein as a "circuit," "module," "component," or "system." Further, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. For example, a computer readable storage medium may be, but not limited to, an electronic, magnetic, optical, electromagnetic, or semiconductor system, apparatus, or device, or any suitable combination of the foregoing. More specific examples of the computer readable storage medium would include, but are not limited to: a portable computer diskette, a hard disk, a random access memory ("RAM"), a read-only memory ("ROM"), an erasable programmable read-only memory ("EPROM" or Flash memory), an appropriate optical fiber with a repeater, a portable compact disc read-only memory ("CD-ROM"), an optical storage device, a magnetic storage device, or any suitable combination of the foregoing. Thus, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. The propagated data signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, or any suitable combination thereof.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages.

Aspects of the present disclosure are described with reference to flowchart illustrations and/or block diagrams of methods, systems and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

Figure 6:
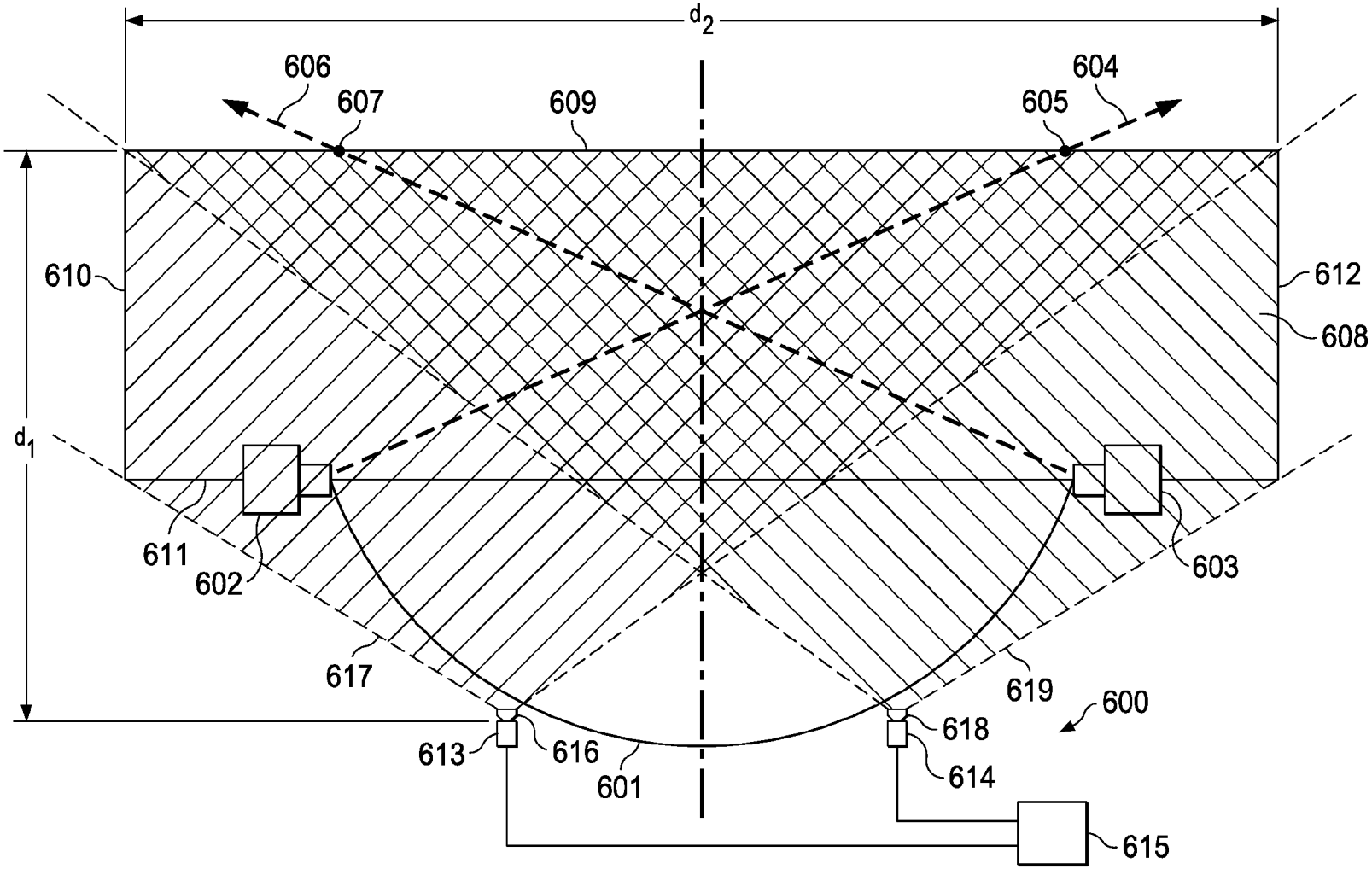
FIG. 6 is a plan view of a video capture system of a preferred embodiment.

Referring to FIG. 6, a preferred embodiment of the system used to record shot sequences is described. Recording system 600 records a set of shot sequences at shooting range 601. A "shot sequence", as used in this application, is a recorded launch of a clay target that lands.

In a preferred embodiment, shooting range 601 is a skeet shooting range. In another embodiment, shooting range 601 is a trap shooting range. In another embodiment, shooting range 601 is a sporting clays range.

In this example, shooting range 601 has high house 602 and low house 603. Target flight path 604 extends from high house 602 to out of bounds marker 605. Target flight path 606 extends from low house 603 to out of bounds marker 607. Field 608 of shooting range 601 is defined by boundary lines 609, 610, 611, and 612.

Recording system 600 has cameras 613 and 614, each connected to recorder 615. Camera 613 has lens 616 and field of view 617. Camera 614 has lens 618 and field of view 619. Cameras 613 and 614 are positioned at distance "$d_1$" from boundary line 609. Cameras 613 and 614 capture a set of video images of the set of shot sequences in field 608 at a predetermined magnification level. Any shot sequence in field 608 is captured in focus by cameras 613 and 614.

In a preferred embodiment, the number of shot sequences in the set of shot sequences is determined by the type of shooting range used and the number of target flight path variations to be recorded. For example, the representative number of shot sequences for a skeet shooting range is at least eight, one shot sequence recorded per station. More than one shot per station may be utilized.

In other embodiments, any number of shot sequences may be recorded.

In one embodiment, a set of background videos is captured and recorded. In this embodiment, the set of background videos is the set of shot sequences without the launch of the clay target. The set of background videos is recorded for the same amount of time as the set of shot sequences. In a preferred embodiment, each shot sequence has a corresponding background video.

In a preferred embodiment, the predetermined magnification level is the one which is perceived by a marksman at shooting range 601 observing the set of shot sequences. In other embodiments, other magnification levels may be employed.

In a preferred embodiment, two cameras, cameras 613 and 614, are used to record the set of shot sequences throughout field 608. In this embodiment, recorder 615 synchronizes video images the set of shot sequences recorded by cameras 613 and 614.

In another embodiment, a plurality of cameras is used to record the set of shot sequences.

In another embodiment, a single camera, having a wide field of view, is used to record the set of shot sequences. In this embodiment, recorder 615 records the set of video images.

In a preferred embodiment, each of cameras 613 and 614 is a Sony F23 444 multi-rate high definition camera. Other suitable high definition cameras known in the art may be employed.

In a preferred embodiment, each of lenses 616 and 618 is a C-Series Zoom lens model no. Hac18x7.6-F manufactured by Fujifilm Holdings of America Corporation and having a focal length range of 7.6 mm to 137 mm.

In a preferred embodiment, recorder 615 is a Panavision SSR-1 digital recorder. Other suitable recorders known in the art may be employed.

Figure 7:
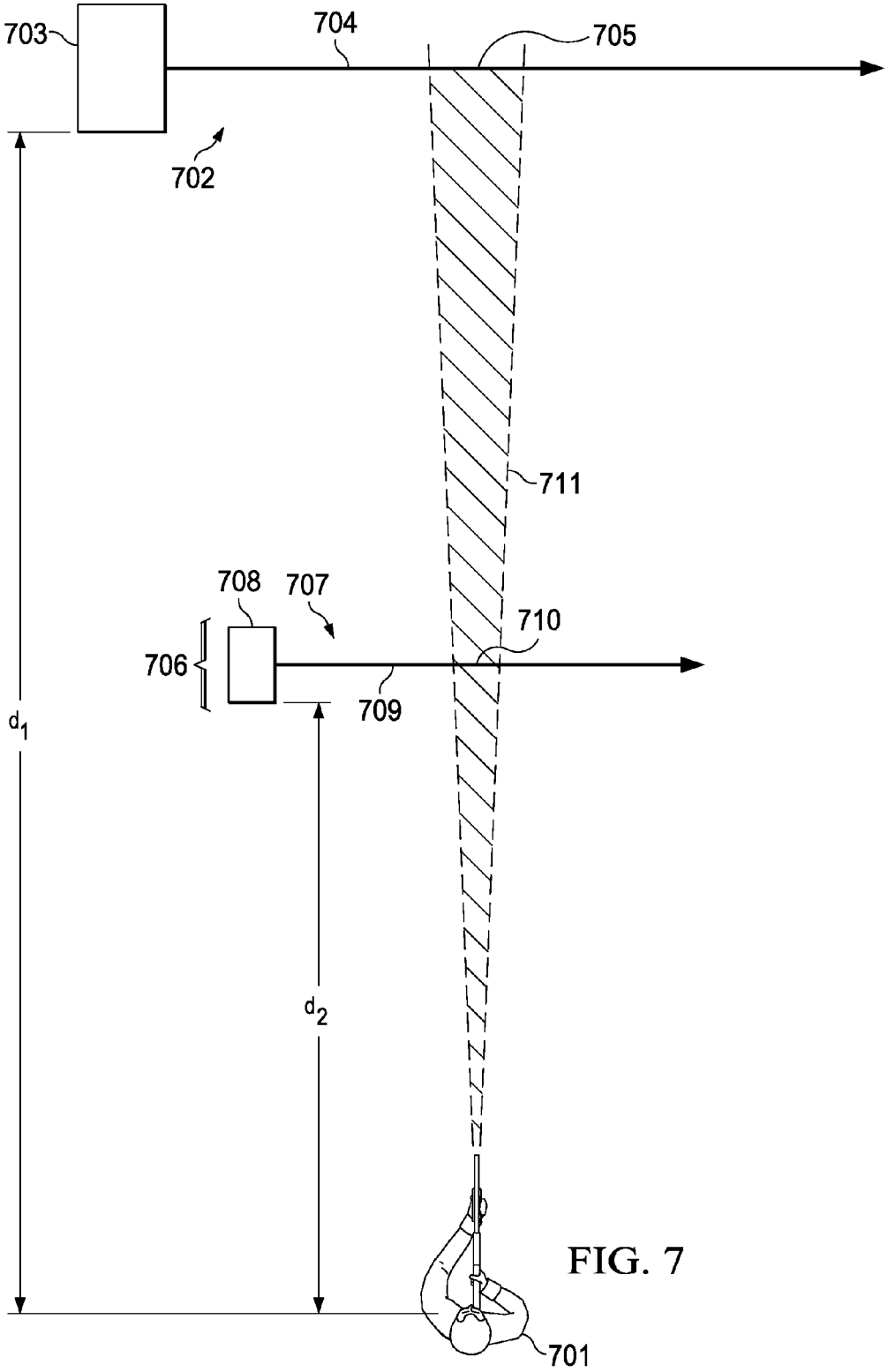
FIG. 7 is a schematic of a field view and a captured video image of the field view of a preferred embodiment.

Referring FIG. 7, a method of scaling the simulation provided is described. Shot sequence 702 occurs at distance "$d_1$" from marksman 701. Marksman 701 has field of view 711. Shot sequence 702 includes images of tower 703, flight path 704, and path portion 705. Recorded video image 706 reproduces recorded shot sequence 707. Recorded shot sequence 707 is a recorded version of shot sequence 702. Recorded shot sequence 707 includes recorded tower 708, recorded flight path 709, and recorded path portion 710. Recorded video image 706 is displayed on a screen at distance "$d_2$" from marksman 701.

In one embodiment, distance "$d_2$" is half of distance "$d_1$". Recorded shot sequence 707 displays the shot sequence at approximately half the size of the original. However, because of the cover distance "$d_2$", marksman 701 perceives recorded tower 707 as the same size as the original shot sequence.

Figure 8A:
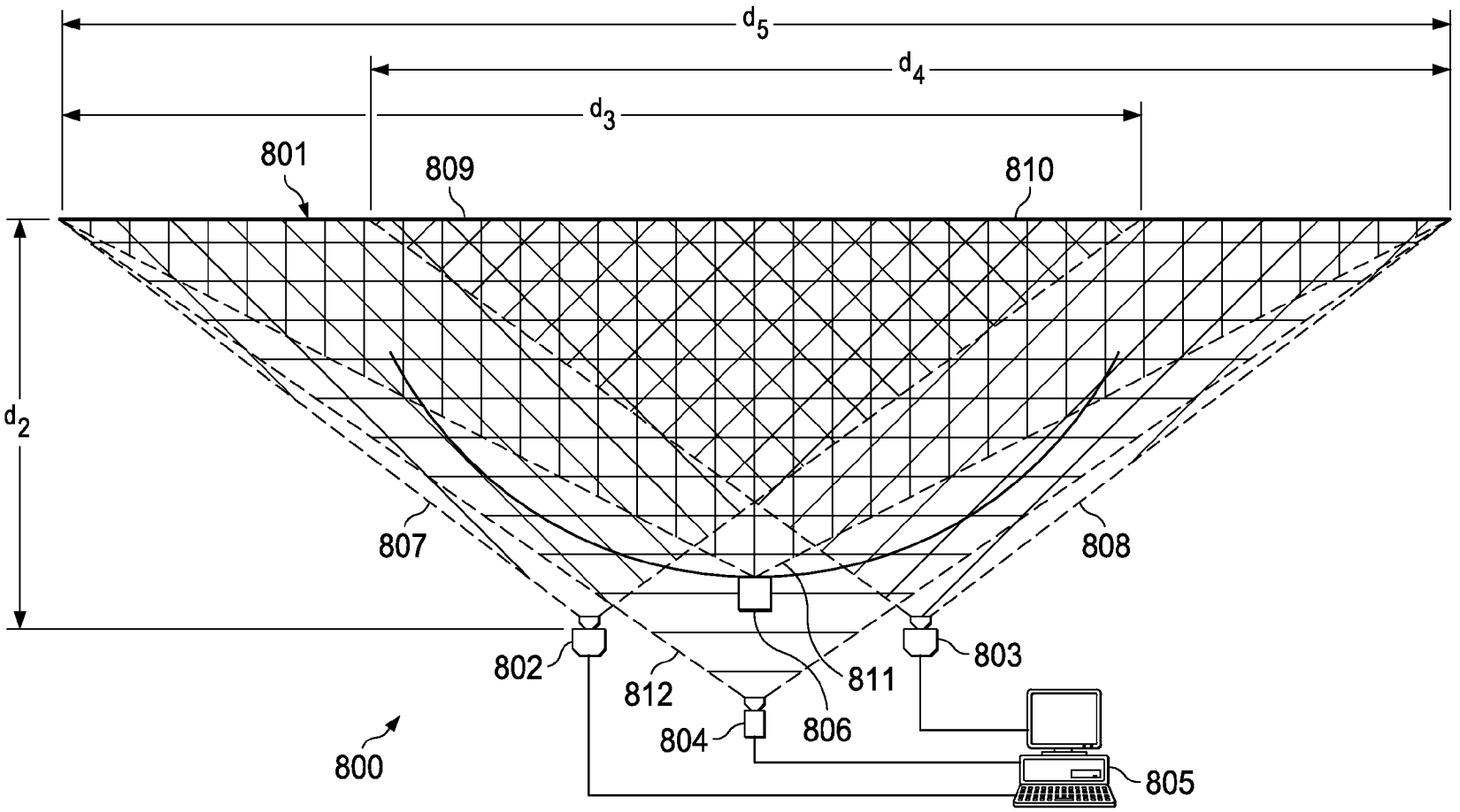
FIG. 8A is a simulator of a preferred embodiment.

Referring to FIG. 8A, a description is provided of the system used to display the recorded shot sequences and record the reactions of the marksman using the system. Simulation system 800 displays a set of modified video images. The set of "modified" video images are created using computer graphics techniques to overlay an image of a phantom clay target onto the set of recorded video images as will be further described below.

Simulation system 800 has screen 801, projectors 802 and 803, camera 804, and computer 805. Projectors 802 and 803 are connected to computer 805. Computer 805 retrieves the set of modified video images and sends them to projectors 802 and 803 which display them on screen 801. Projectors 802 and 803 are positioned at about distance "$d_2$" from screen 801. Camera 804 is connected to computer 805. Marksman 806 is positioned between projectors 802 and 803 and between camera 804 and screen 801 to view screen 801. Camera 804 and computer 805 record marksman 806 using simulation system 800 for analysis as will be further described below.

Projector 802 has throw 807. Throw 807 covers screen portion 809 of screen 801. Projector 803 has throw 808. Throw 808 covers screen portion 810 of screen 801. Screen portion 809 has width portion "$d_3$". Screen portion 810 has width portion "$d_4$". Screen 801 has width "$d_5$". Marksman 806 has view 811. View 811 covers width "$d_5$" of screen 801. Camera 804 has field of view 812. Field of view 812 covers width "$d_3$" of screen 801 and marksman 806. Computer 805 dithers the video overlaid of screen portion 809 and screen portion 810 to eliminate multiple images.

In a preferred embodiment, screen 801 is a GrayMatte 70 projection screen available from Stewart Filmscreen Corporation of Torrance, Calif. Other suitable projection screens known in the art may be employed.

In other embodiments, any reflective surface may be utilized. For example, a wall may be employed as the reflective surface.

In a preferred embodiment, each of projectors 802 and 803 is a Christie Matrix WU14K-J projector available from Christie Digital Systems USA, Inc. of Cypress, Calif. Other suitable projectors known in the art may be employed.

In a preferred embodiment, camera 804 is a Canon XF100 High Definition Camcorder. Other suitable video cameras known in the art may be employed.

In a preferred embodiment, computer 805 is a personal computer having a processor and a memory connected to the processor running Windows 8 operating system. Other suitable personal computers known in the art may be employed.

Figure 8B:
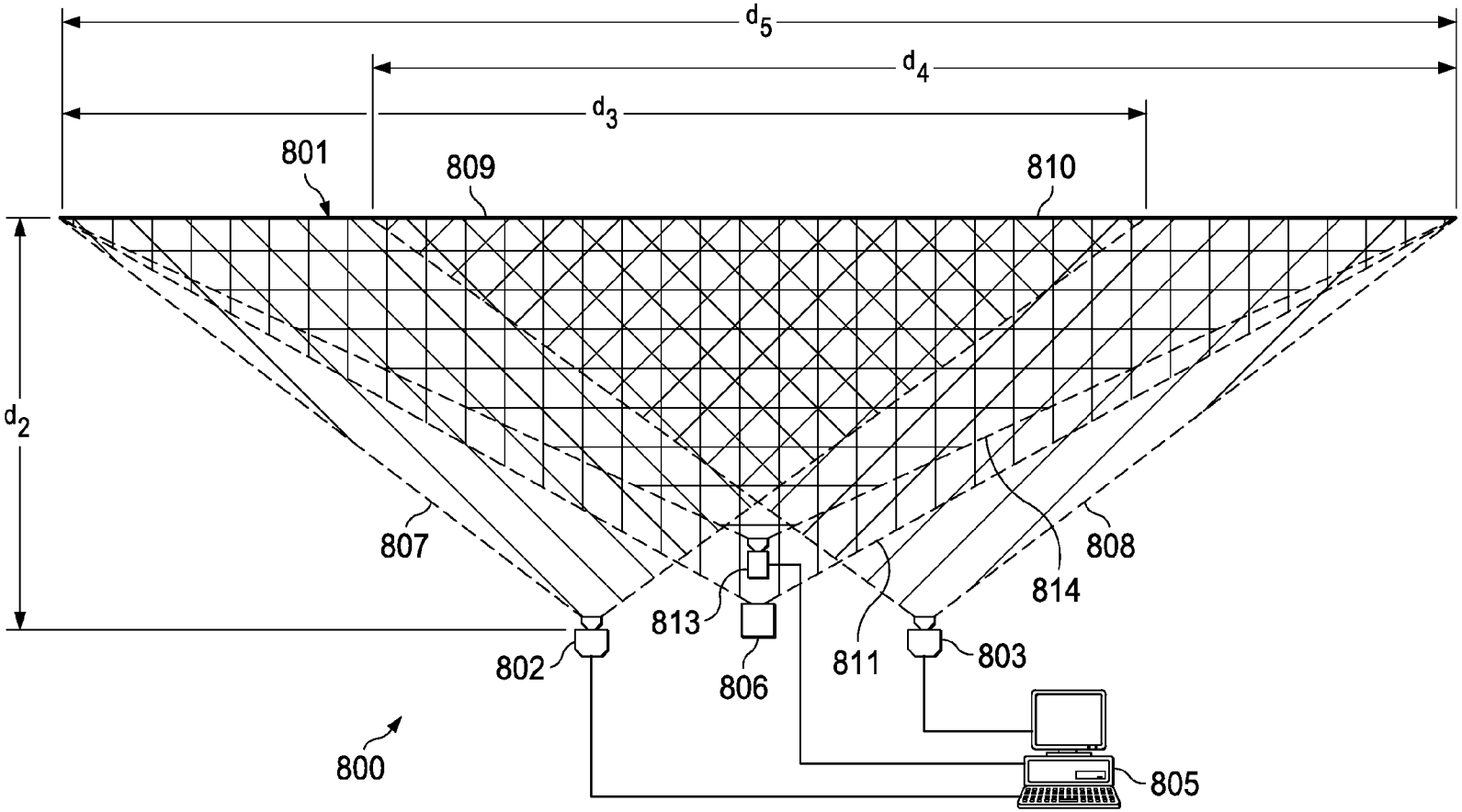
FIG. 8B is a simulator of a preferred embodiment.

Referring to FIG. 8B in another embodiment, simulation system 800 has screen 801, projectors 802 and 803, infrared camera 813, and computer 805. Projectors 802 and 803 are connected to computer 805. Computer 805 retrieves the set of modified video images and sends them to projectors 802 and 803 which display them on screen 801. Projectors 802 and 803 are positioned at about distance "$d_2$" from screen 801. Infrared camera 813 is connected to computer 805. Infrared camera 813 is positioned between marksman 806 and screen 801. Computer 805 maps a set of coordinates of infrared camera 813 to a set of coordinates of projectors 802 and 803 to calibrate infrared camera 813 and enable infrared camera 813 to detect a position of an infrared light source reflected from screen 801 as will be further described below.

Projector 802 has throw 807. Throw 807 covers screen portion 809 of screen 801. Projector 803 has throw 808. Throw 808 covers screen portion 810 of screen 801. Screen portion 809 has width portion "$d_3$". Screen portion 810 has width portion "$d_4$". Screen 801 has width "$d_5$". Marksman 806 has view 811. View 811 covers width "$d_5$" of screen 801. Infrared camera 813 has field of view 814. Field of view 814 covers width "$d_5$" of screen 801. Computer 805 dithers the video overlaid of screen portion 809 and screen portion 810 to eliminate multiple images.

In a preferred embodiment, infrared camera 813 is a Wii Remote available from Nintendo of America, Inc. In another embodiment, infrared camera 813 is a CMOS image sensor available from PixArt Imaging Inc. of Taiwan. Other suitable infrared optical sensors known in the art may be employed.

Figure 9:
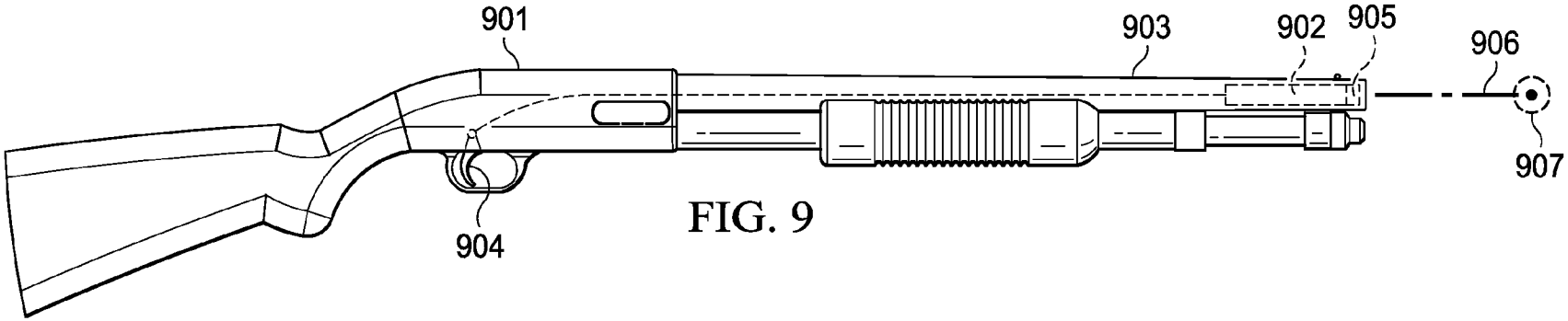
FIG. 9 is a side view of a weapon of a preferred embodiment.

Referring to FIG. 9, weapon 901 has laser 902 mounted in barrel 903 of the weapon. Laser 902 connects to trigger 904. Laser 902 has diffuser 905 to focus light emitted from laser 902 along axis 906. Laser 902 and diffuser 905 produce simulated shot string 907.

In one embodiment, laser 902 is an infrared laser diode. In this embodiment, simulated shot string 907 is infrared light.

Figure 10:
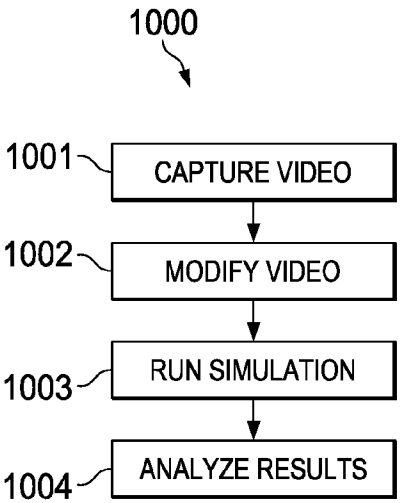
FIG. 10 is flowchart of a method for operating a simulator of a preferred embodiment.

Referring to FIG. 10, method 1000 is described. In step 1001, a set of video images of a plurality of shot sequences is recorded. The shot sequences are taken of various trajectories of the target in order to provide a range of challenges for the marksman. In a preferred embodiment, recording system 600 is used to perform step 1001.

In step 1002, the set of recorded video images are modified. In step 1003, a simulation is run using the modified video images. In step 1004, the results of the simulation are analyzed.

Figure 11A:
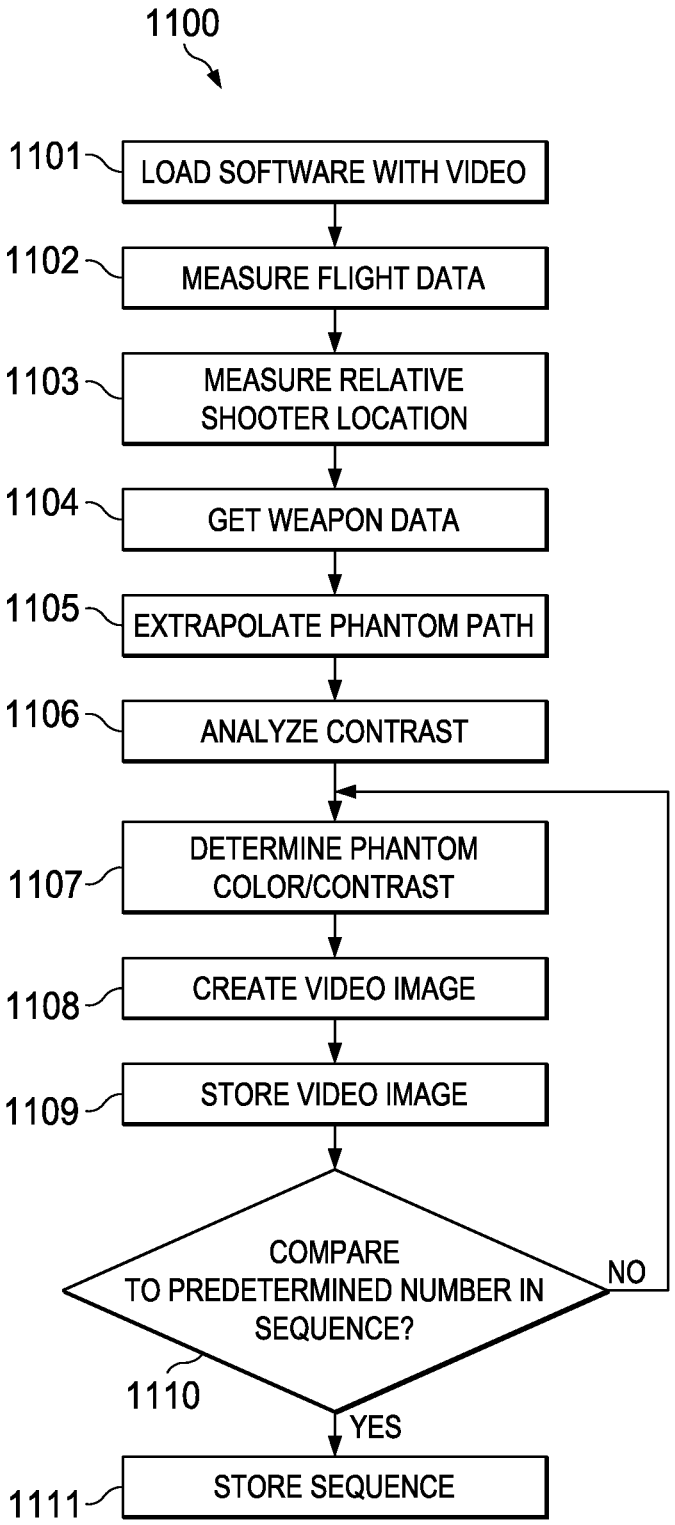
FIG. 11A is a flowchart of a method for modifying a video of a preferred embodiment.

Referring to FIG. 11A, method 1100 for modifying a set of video images is described in detail. In step 1101, a set of video images are loaded into a video editing software program. In a preferred embodiment, the video editing software is Adobe® After Effects® CS6, available for purchase from Adobe Systems Inc. of San Jose, Calif. to create Flash videos. Other suitable video editing software programs known in the art may be employed.

In step 1102, a set of clay target flight data in the set of video images is measured. In a preferred embodiment, the set of clay target flight data comprises a launch angle of the clay target, an initial velocity of the clay target, a mass of the clay target, a clay target flight time, a wind velocity, a drag force, a lift force, an air temperature, an altitude, a relative air humidity, an outdoor illuminance, a shape of the clay target, and a color of the clay target, and a clay target brightness level.

In step 1103, a relative location of a marksman in the set of video images with respect to a clay target launch point is determined.

In step 1104, a set of weapon data is determined. In a preferred embodiment, the set of weapon data comprises a weapon type e.g., a shotgun, a rifle, or a handgun, a weapon caliber or gauge, a shot type further comprising a load, a caliber, a pellet size, and shot mass, a barrel length, a choke type, and a muzzle velocity.

Figure 11B:
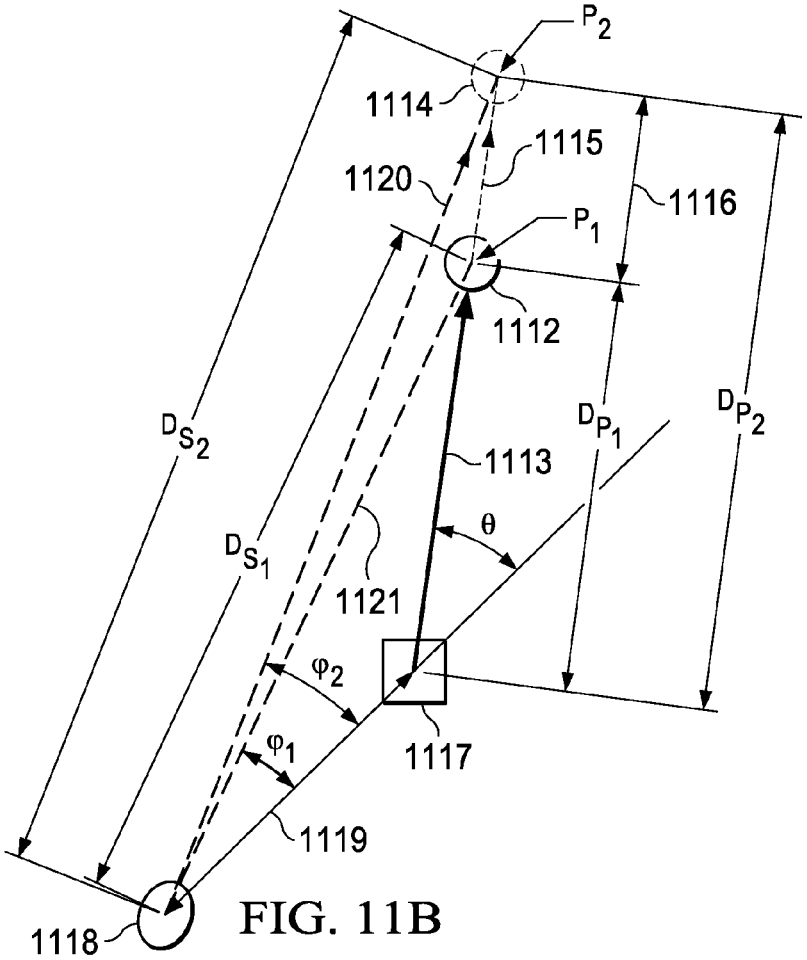
FIG. 11B is a plan view a clay target and a phantom clay of a preferred embodiment.
Figure 11C:
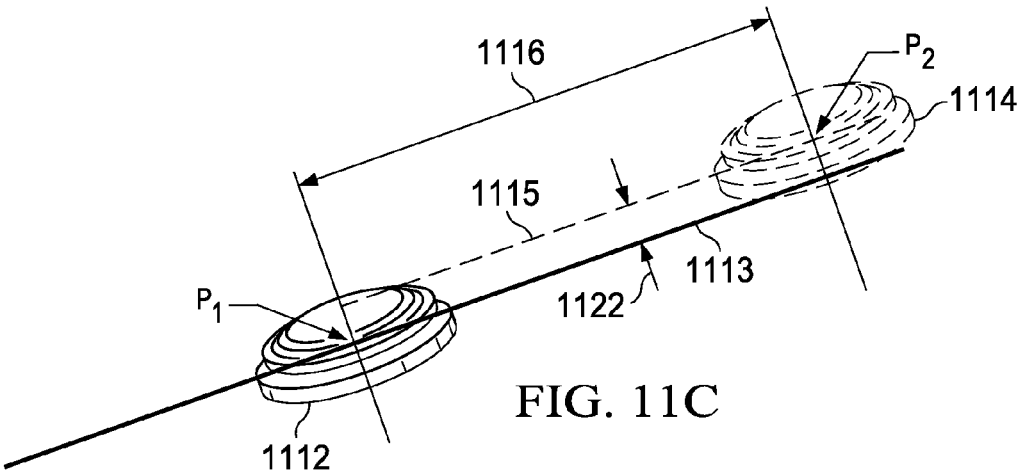
FIG. 11C is an isometric view of a clay target and a phantom clay of a preferred embodiment.

In step 1105, a phantom path is extrapolated. Referring to FIGS. 11B and 11C, clay target 1112 is launched from launch point 1117 and moves along target path 1113 at position $P_1$. Phantom clay target 1114 moves along phantom path 1115 ahead of clay target 1112 at position $P_2$. Position $P_2$ is lead distance 1116 and drop distance 1122 from position $P_1$. Phantom path 1115 varies as clay target 1112 and target path 1113 varies, thereby varying lead distance 1116. Marksman 1118 is positioned at distance 1119 from launch point 1117. Marksman 1118 aims at phantom clay target 1114 and shoots along shot path 1120 to intercept clay target 1112. Target path 1113 is extrapolated over time using the set of clay target flight data. Target path 1113 is calculated using equations (1)-(4).

Referring to FIG. 11B, lead distance 1116 is calculated using target path 1113, the relative marksman location, and the set of weapon data.

$$D_{P_2} \approx \frac{D_{S_2}\tan\varphi_2}{\cos\theta\tan\varphi_2 - \sin\theta} \tag{7}$$

$$D_{P_1} \approx \frac{D_{S_1}\tan\varphi_1}{\cos\theta\tan\varphi_1 - \sin\theta} \tag{8}$$

where $D_{P_2}$ is the distance of phantom clay target 1114 at position $P_2$ from launch point 1117, $D_{S_2}$ is the distance from marksman 1118 to phantom clay target 1114 along shot path 1120, $\phi_2$ is the angle between shot path 1120 and distance 1119, θ is the launch angle between target path 1113 and distance 1119, $D_{P_1}$ is the distance of clay target 1112 at position $P_1$ from launch point 1117, $D_{S_1}$ is the distance from marksman 1118 to clay target 1112 along shot path 1121, $\phi_1$ is the angle between shot path 1121 and distance 1119, θ is the launch angle between target path 1113 and distance 1119. Lead distance 1116 is:

$$D_{Lead} \approx D_{P_2} - D_{P_1} \tag{9}$$

$$D_{Lead} \approx \frac{A\Delta D_S \tan C\Delta\varphi}{\cos B\theta \tan C\Delta\varphi - \sin B\theta} \tag{10}$$

where $D_{Lead}$ is lead distance 1116, $\Delta D_S$ is the difference between the distances of shot paths 1120 and 1121, Ago is the difference between angles $\phi_2$ and $\phi_1$, θ is the launch angle between target path 1113 and distance 1119, A is a variable multiplier for shot size, gauge, and shot mass, B is a variable multiplier for θ including vibration of a clay target thrower and a misaligned clay target in the clay target thrower, and C is a variable multiplier for drag, lift, and wind.

For example, the approximate times it takes for a 7½ shot size shell with an initial muzzle velocity of approximately 1,225 feet per second to travel various distances is shown in Table 1.

TABLE 1

Time and Distances of a 7½ Shot

| Distance from barrel | Time (seconds) |
|---|---|
| 30 feet | 0.027 |
| 60 feet | 0.060 |
| 90 feet | 0.097 |
| 120 feet | 0.139 |
| 150 feet | 0.186 |
| 180 feet | 0.238 |

Various lead distances between clay target 1112 and phantom clay target 1114 for clay target 1112 having an initial velocity of approximately 30 mph is shown in Table 2.

TABLE 2

Lead Distances with a 7½ Shot on a Full Crossing Shot

| Distance from Barrel | Lead Distance |
|---|---|
| 60 feet | 2.64 feet |
| 90 feet | 4.62 feet |
| 120 feet | 5.56 feet |

Referring to FIG. 11C, phantom path 1115 is offset from target path 1113 by drop distance 1122 to simulate and compensate for the average exterior ballistics drop of a shot.

The "drop of a shot" is the effect of gravity on the shot during the distance traveled by the shot. The shot trajectory has a near parabolic shape. Due to the near parabolic shape of the shot trajectory, the line of sight or horizontal sighting plane will cross the shot trajectory at two points called the near zero and far zero in the case where the shot has a trajectory with an initial angle inclined upward with respect to the sighting device horizontal plane, thereby causing a portion of the shot trajectory to appear to "rise" above the horizontal sighting plane. The distance at which the weapon is zeroed, and the vertical distance between the sighting device axis and barrel bore axis, determine the amount of the "rise" in both the X and Y axes, i.e., how far above the horizontal sighting plane the rise goes, and over what distance it lasts.

Drop distance 1122 is calculated by:

$$D_{Drop} \approx v_t \tau \ln\left[\cosh\left(\frac{t_{impact}}{\tau}\right)\right] \tag{11}$$

where $D_{Drop}$ is drop distance 1122, $t_{impact}$ is the time required for a shot string fired by marksman 1118 to impact clay target 1114. $T_{impact}$ is determined by a set of lookup tables having various impact times at predetermined distances for various shot strings.

$$v_t = \sqrt{\frac{2\ mg}{C\rho A}}\text{, and} \tag{12}$$

$$\tau = \frac{v_t}{g} \tag{13}$$

where $v_t$ is the terminal velocity of clay target 1114, m is the mass of clay target 1114, g is the vertical acceleration due to gravity, C is the drag coefficient for clay target 1114, ρ is the density of the air, A is the planform area of clay target 1114, and τ is the characteristic time.

Returning to FIG. 11A, in step 1106, a relative contrast value between the clay target and a background surrounding the clay target is analyzed by calculating the difference between a grayscale brightness of the clay target and an average brightness of the background surrounding the clay target and the difference between an average color of the clay target and a color of the background surrounding the clay target.

In step 1107, a color and a contrast level of a phantom clay target is determined.

In a preferred embodiment, the phantom clay target comprises a set of pixels set at a predetermined contrast level. The predetermined contrast level is determined by the difference of the color between the phantom clay target and the clay target and the difference of the brightness between the phantom clay target and the clay target. In this embodiment, the predetermined contrast level is a range from a fully opaque image to a fully transparent image with respect to the image of the clay target and the image of the background.

In a preferred embodiment, the set of pixels is set at a predetermined color. For example, blaze orange has a pixel equivalent setting of R 232, G 110, B0.

In step 1108, a modified video image is created. In a preferred embodiment, a phantom clay target is overlaid onto the loaded video image. In this embodiment, the phantom clay target is a copy of the clay target located at lead distance 1116 and drop distance 1122 ahead of the clay target with the color and contrast level determined in step 1107.

In one embodiment, a screen hotspot is overlaid onto the phantom clay target to create a phantom hotspot. The phantom hotspot enables the phantom clay target to be "selected" with the phantom hotspot with a mouse or any other suitable pointing device known in the art and defines an action to be taken by the computer when "selected" as will be further described below. In this embodiment, the phantom hotspot is transparent. In this embodiment, a background video is copied to create the set of background videos.

In step 1109, the modified video image is stored in memory. In step 1110, a sequence number is compared to a predetermined number of shot sequences. The predetermined number of shot sequences is the number of modified video images shown during the simulation. If the sequence number is less than the predetermined number of shot sequences, then method 1100 returns to step 1107. If the sequence number equals the predetermined number of shot sequences, then method 1100 proceeds to step 1111. In step 1111, a set of modified video images for a shot sequence is stored in memory.

Figure 12A:
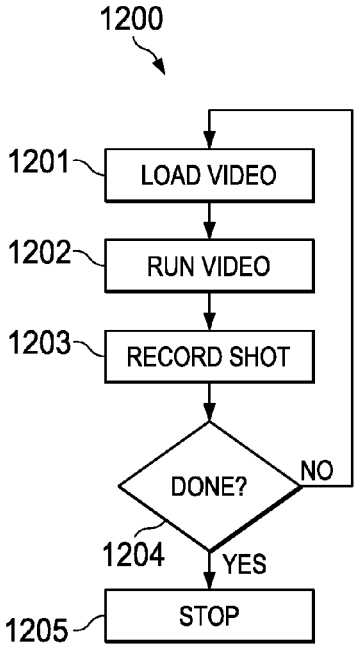
FIG. 12A is a flowchart of a method for running a simulation of a preferred embodiment.

Referring to FIG. 12A in one embodiment, method 1200 for running a simulation is described in further detail. In step 1201, the set of modified video images is loaded in the simulation system. In step 1202, the first of the set of modified video images is projected onto a screen by the simulation system.

In step 1203, a shot attempt by a marksman is recorded by a camera of the simulation system. In a preferred embodiment, the camera simultaneously records the position of the marksman and the modified video image being projected on the screen.

In step 1204, whether the simulation is complete is determined. In a preferred embodiment, the simulation is complete after each modified video image of the set of modified images has been projected and has recorded a marksman making a shot. If the simulation is not done, then method 1200 returns to step 1201 and runs the video of the next modified video image of the set of modified video images. If the simulation is complete, then the simulation stops in step 1205.

Figure 12B:
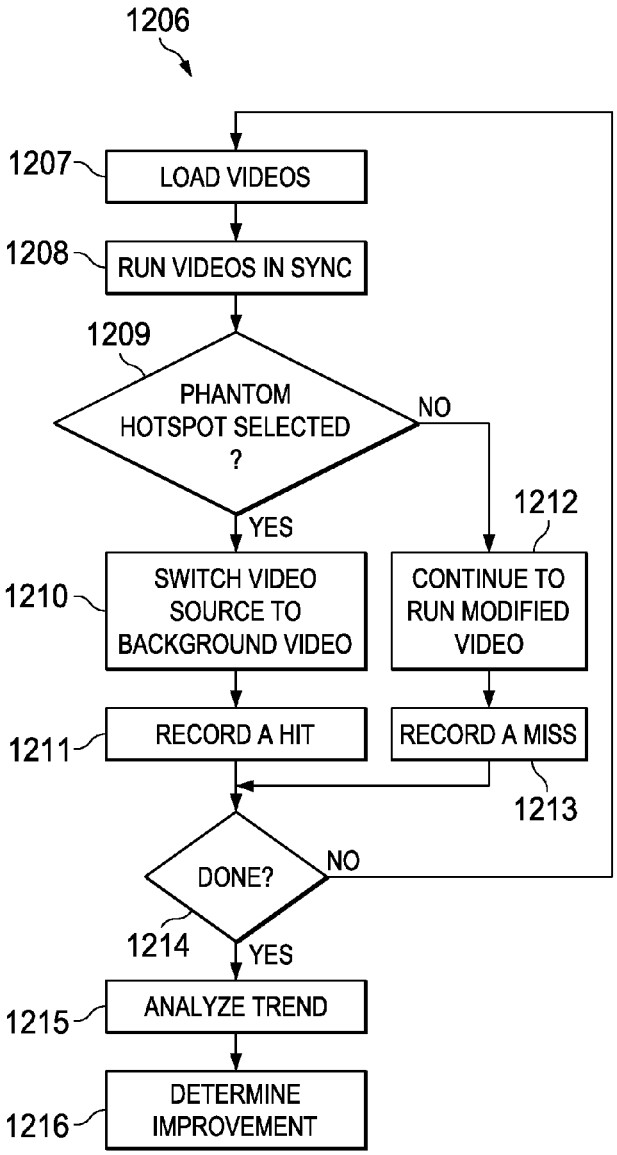
FIG. 12B is a flowchart of a method for running a simulation of a preferred embodiment.

Referring to FIG. 12B in another embodiment, method 1206 for running a simulation is described in further detail. In step 1207, the set of modified video images and the set of background videos are loaded into the simulation system. In this embodiment, each of the set of modified video images includes a phantom hotspot. In step 1208, the first of the set of modified video images and the first of the set of background images are synchronously run by the simulation system. The first of the set of modified video images is projected onto the screen by the simulation system. The first of the set of background images is run in the background by the simulation system, i.e., not projected onto the screen.

In step 1209, whether the phantom hotspot has been "selected" is determined. An infrared camera detects the position of an infrared shot string. The infrared shot string is calculated by:

$$A_{shot\ string}=\pi R_{string}^2 \tag{14}$$

$$R_{string}=R_{initial}+v_{spread}t \tag{15}$$

where $A_{shot\ string}$ is the area of the infrared shot string, $R_{string}$ is the radius of the infrared shot string, $R_{initial}$ is the radius of the shot as it leaves the weapon, $v_{spread}$ is the rate at which the shot spreads, and t is the time it takes for the shot to travel from the weapon to the clay target.

If the position of the infrared shot string overlaps the phantom hotspot, then the phantom hotspot is "selected". If the position of the infrared shot string does not overlap the phantom hotspot, then the phantom hotspot is not "selected".

In step 1210, if the phantom hotspot is selected, then the simulation system switches a video source projected onto the screen from the first of the set of modified video images to the first of the set of background videos and the first of the set of background videos is projected onto the screen until completion. The first of the set of modified video images runs in the background until completion. In step 1211, the simulation system records a "hit" in a database.

In step 1212, if the phantom hotspot is not selected, then the first of the set of modified video images continues to be projected onto the screen by the simulation system until completion and the first of the set of background videos runs in the background until completion. In step 1213, the simulation system records a "miss" in the database.

In step 1214, whether the simulation is complete is determined. In a preferred embodiment, the simulation is complete after each modified video image of the set of modified images and has been projected and each background video of the set of background videos has run and a "hit" or a "miss" has been recorded. If the simulation is not done, then method 1206 returns to step 1207 and synchronously runs the video of the next modified video image of the set of modified video images and the video of the next background video of the set of the background videos. If the simulation is complete, then a trend of shot attempts is analyzed in step 1215 by retrieving a number of "hits" in the set of shot sequences and a number of "misses" in the set of shot sequences from the database. In step 1216, a shot improvement is determined by evaluating the number of hits in the set of shot sequences and the number of misses in the set of shot sequences.

Figure 13:
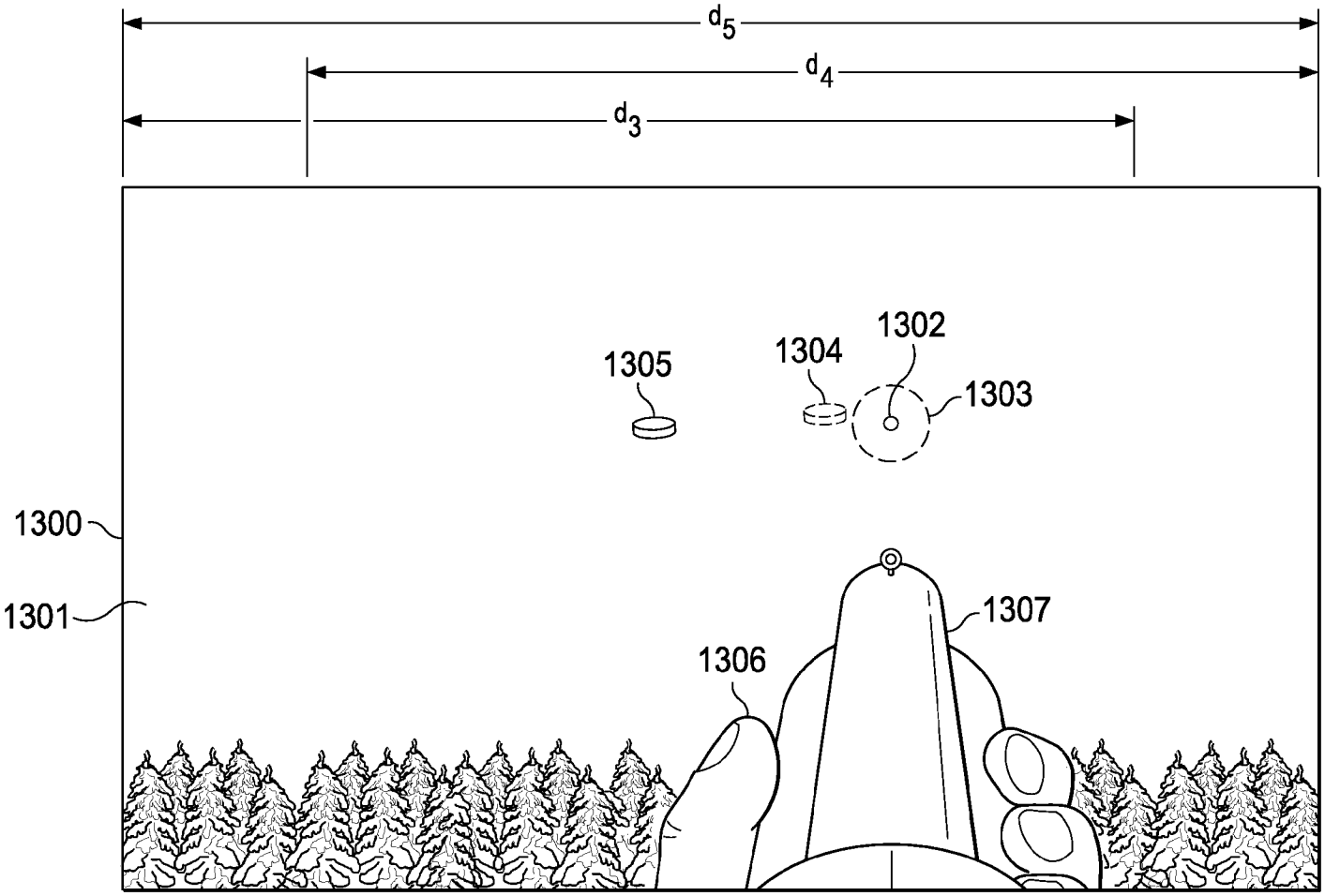
FIG. 13 is a screen capture of a simulation of a preferred embodiment.

Referring to FIG. 13, a view of a simulation from the perspective of the marksman is shown. Screen 1300 has background 1301, phantom clay target 1304, and clay target 1305. Screen 1300 has width "$d_5$". Width "$d_5$" is roughly equal to the width of the scaled down presentation display. Distance "$d_3$" is roughly scaled to show the image recorded by camera 1. Distance "$d_4$" is roughly scaled to show the image recorded by camera 2. The video overlaid of "$d_3$" and "$d_4$" is dithered to evaluate multiple changes. Marksman 1306 aims weapon 1307 at screen 1300. Laser spot 1302 appears on screen 1300 when marksman 1306 pulls a trigger of weapon 1307. Shot string 1303 surrounds laser spot 1302. In a preferred embodiment, shot string 1303 is a simulation of a shot pellet spread fired from weapon 1301.

In another embodiment, laser spot 1302 does not appear on the screen when marksman 1306 pulls the trigger of weapon 1307 and shot string 1303 is an infrared shot string.

Figure 14:
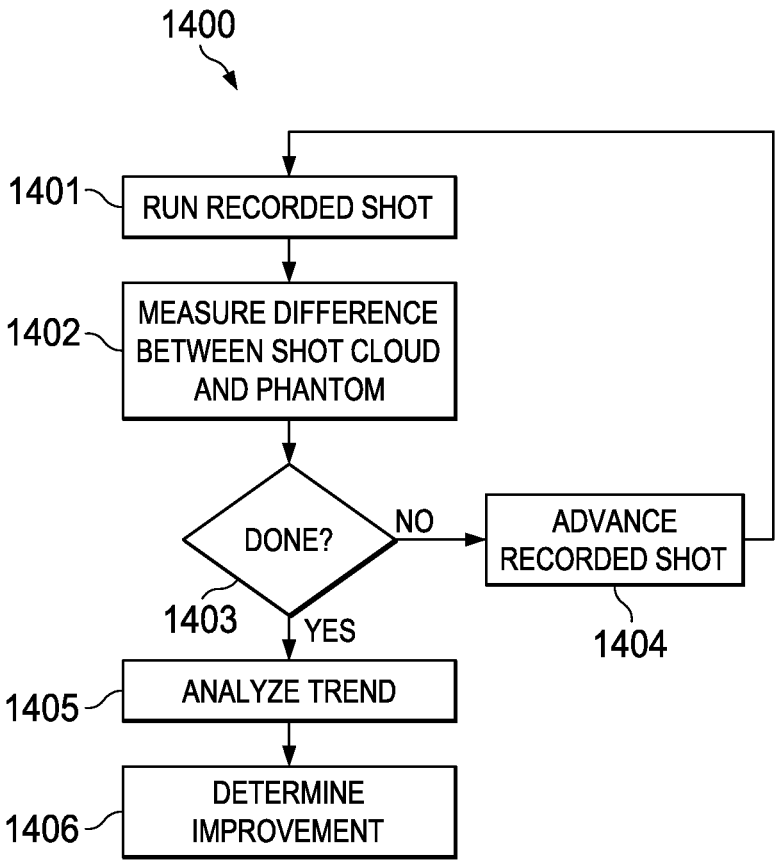
FIG. 14 is a flowchart of a method for analyzing results of a simulation of a preferred embodiment.

Referring to FIG. 14, method 1400 for analyzing results of a simulation is described in further detail. In step 1401, a video of a recorded shot in a set of shot sequences is run. In step 1402, a difference between a shot string and a phantom clay target is measured. The shot string is calculated using equations (14) and (15).

If the shot string overlaps the phantom clay target, then the recorded shot is a "hit." If the measured difference between the shot string and the phantom clay target is equal to or greater than zero (0), then the recorded shot is a "miss." In step 1403, whether the simulation is complete is determined. If the simulation is not complete, then method 1400 advances to the subsequent recorded shot in the set of shot sequences in step 1404. If the simulation is complete, then a trend of the recorded shots is analyzed in step 1405. In step 1406, a shot improvement is determined by evaluating a number of hits in the set of shot sequences and a number of misses in the set of shot sequences.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A system for analyzing a set of shot attempts comprising:

a reflective surface;

a computer, further comprising a processor and a memory connected to the processor, directed toward the reflective surface;

a camera connected to the computer and directed toward the reflective surface;

a set of projectors connected to the computer and directed toward the reflective surface;

a light beam emitting device directed toward the reflective surface;

the processor programmed to carry out the steps of:

receiving a shot sequence;

measuring a set of target flight data from the shot sequence;

extrapolating a path for a phantom from the set of target flight data;

determining a lead distance from the set of target flight data;

determining a drop distance from the set of target flight data;

adding the phantom to the shot sequence, along the path, at a predetermined set of contrast levels, at the lead distance, at the drop distance, to create a set of modified shot sequences;

directing each modified shot sequence of the set of modified shot sequences to the set of projectors in a predetermined order related to the predetermined set of contrast levels;

recording a shot attempt for each modified shot sequence of the set of modified shot sequences to create a set of shot attempts; and, analyzing the set of shot attempts.

2. The system of claim 1 wherein the processor is further programmed to carry out the step of scaling each modified shot sequence of the set of modified shot sequences at a predetermined magnification.

3. The system of claim 1 wherein the shot attempt further comprises a shot string emitted by the light beam emitting device and wherein the processor is further programmed to carry out the steps of:

measuring a difference between the shot string and the phantom; and, analyzing a trend from the difference.

4. The system of claim 1 wherein the predetermined set of contrast levels is in a range from opaque to transparent and wherein the predetermined order is a sequential order of the predetermined set of contrast levels from opaque to transparent.

5. The system of claim 1 wherein the processor is further programmed to carry out the step of calculating a trajectory angle from the set of target flight data for the path.

6. The system of claim 1 wherein the processor is further programmed to carry out the step of receiving a visual shot reflection from the reflective surface associated with the shot attempt from the camera.

7. The system of claim 1 wherein the processor is further programmed to carry out the steps of:

dithering a pair of images of each modified shot sequence of the set of modified shot sequences to create a set of dithered images; and, directing the set of dithered images to the set of projectors.

8. A system for marksmanship training comprising:

a reflective surface;

a computer further comprising a processor and a memory connected to the processor, directed toward the reflective surface;

a set of projectors connected to the computer and directed toward the reflective surface;

an infrared camera connected to the computer and directed toward the reflective surface;

an infrared light emitting device directed toward the reflective surface;

the processor programmed to carry out the steps of:

receiving a shot sequence;

receiving a background video;

measuring a set of target flight data from the shot sequence;

extrapolating a path for a phantom from the set of target flight data;

determining a lead distance from the set of target flight data;

determining a drop distance from the set of target flight data;

adding a hotspot to the phantom;

adding the phantom to the shot sequence, along the path, at a predetermined set of contrast levels, at the lead distance, at the drop distance, to create a set of modified shot sequences;

sending each modified shot sequence of the set of modified shot sequences in a predetermined order related to the set of projections at the predetermined set of contrast levels;

directing each modified shot sequence of the set of modified shot sequences as a video source to the set of projectors;

determining a selection of the hotspot by the light beam emitting device; and, if the hotspot is selected, then switching the video source to the background video.

9. The system of claim 8 wherein the processor is further programmed to carry out the step of scaling the set of modified shot sequences.

10. The system of claim 8 wherein the processor is further programmed to carry out the steps of:

determining a hotspot position of the hotspot from each modified shot sequence of the set of modified shot sequences;

determining a shot string position received by the infrared camera for a modified shot sequence of the set of modified shot sequences; and, measuring an overlap between the hotspot position and the shot string position.

11. The system of claim 10 wherein the processor is further programmed to carry out the step of analyzing a trend from the overlap.

12. The system of claim 8 wherein the predetermined set of contrast levels is a range from opaque to transparent and wherein the predetermined order is a sequential order of the predetermined set of contrast levels from opaque to transparent.

13. The system of claim 8 wherein the processor is further programmed to carry out the step of calculating a trajectory angle from the set of target flight data for the path.

14. The system of claim 8 wherein the processor is further programmed to carry out the steps of:

dithering a pair of images of each modified shot sequence of the set of modified shot sequences to create a set of dithered shot sequence images; and, directing the set of dithered shot sequence images as the video source to the set of projectors.

15. The system of claim 8 wherein the processor is further programmed to carry out the steps of:

dithering a pair of images of each background video of the set of background videos to create a set of dithered background images; and, directing the set of dithered background images as the video source to the set of projectors.

16. A method for training a marksman comprising:

receiving a shot sequence;

measuring a set of target flight data from the shot sequence;

extrapolating a path for a phantom from the set of target flight data;

determining a lead distance from the set of target flight data;

determining a drop distance from the set of target flight data;

adding the phantom to the shot sequence along the path, at a predetermined set of contrast levels, at the lead distance, at the drop distance, to create a set of modified shot sequences;

displaying each modified shot sequence of the set of modified shot sequences in a predetermined order related to the predetermined set of contrast levels;

recording a shot attempt for each modified shot sequence of the set of shot sequences to create a set of shot attempts; and, analyzing the set of shot attempts to train the marksman.

17. The method of claim 16 wherein the step of projecting further comprises the step of scaling the set of modified shot sequences to a predetermined magnification.

18. The method of claim 16 wherein each shot attempt of the set of shot attempts further comprises a shot string and wherein the step of analyzing further comprises the steps of:

measuring a difference between the shot string and the phantom; and, analyzing a trend from the difference.

19. The method of claim 16 further comprising the step of recording the shot sequence.

20. The method of claim 19 wherein the step of recording further comprises the step of varying a target trajectory at one of the group of an oblique angle and an acute angle.

21. The method of claim 16 wherein the predetermined set of contrast levels is a range from opaque to transparent and wherein the step of projecting further comprises the step of displaying each modified shot sequence in a sequential order from opaque to transparent.

22. The method of claim 16 wherein the step of extrapolating further comprises the step of calculating a trajectory angle from the set of target flight data for the path.

23. The method of claim 16 wherein the step of recording a shot attempt further comprises receiving a visual shot reflection associated with the shot attempt.

24. The method of claim 16 wherein the step of projecting further comprises the steps of:

dithering a pair of images of each modified shot sequence of the set of modified shot sequences to create a set of dithered images; and, displaying the set of dithered images.

25. A method for training a marksman comprising:

receiving a shot sequence;

receiving a background video;

measuring a set of target flight data from the shot sequence;

determining a path for a phantom from the set of target flight data;

determining a lead distance from the set of target flight data;

determining a drop distance from the set of target flight data;

determining a path for a hotspot from the set of target flight data;

adding the phantom to the shot sequence, along the path, at a predetermined set of contrast levels, at the lead distance, at the drop distance, to create a set of modified shot sequences;

displaying each modified shot sequence of the set of modified shot sequences in a predetermined order related to the predetermined set of contrast levels;

determining a selection of a hotspot;

displaying background video of the set of background videos if a hotspot is selected; and, analyzing the selection to train the marksman.

26. The method of claim 25 wherein the step of displaying each modified shot sequence further comprises the step of scaling each modified shot sequence of the set of modified shot sequences and the background video.

27. The method of claim 25 wherein the step of determining a selection of the hotspot further comprises the steps of:

determining a hotspot position of the hotspot from each modified shot sequence of the set of modified shot sequences;

determining a shot string position reflected from a reflective surface from each modified shot sequence of the set of modified shot sequences; and, measuring an overlap between the hotspot position and the shot string position.

28. The method of claim 27 wherein the step of analyzing the selection further comprises the step of analyzing a trend from the overlap.

29. The method of claim 25 further comprising the step of recording the shot sequence and the background video.

30. The method of claim 29 wherein the step of recording further comprises the step of varying a target trajectory at one of the group of an oblique angle and an acute angle.

31. The method of claim 25 wherein the predetermined set of contrast levels is a range from opaque to transparent and wherein the step of displaying each modified shot sequence further comprises the step of displaying each modified shot sequence of the set of modified shot sequences in a sequence while varying the contrast level from opaque to transparent.

32. The method of claim 25 wherein the step of determining further comprises the step of calculating a trajectory angle from the set of target flight data for the path.

33. The method of claim 25 wherein the step of projecting each shot sequence of the set of shot sequences further comprises the steps of:

dithering a pair of images of each modified shot sequence of the set of modified shot sequences to create a set of dithered shot sequence images; and, displaying the set of dithered shot sequence images.

34. The method of claim 25 wherein the step of displaying each modified sequence further comprises the steps of:

dithering a pair of images of each background video of the set of background videos to create a set of dithered background images; and, displaying the set of dithered background images as the video source onto the reflective surface.

* * * * *